US011655529B2

(12) United States Patent
Li et al.

(10) Patent No.: US 11,655,529 B2
(45) Date of Patent: May 23, 2023

(54) ZR-BASED AMORPHOUS ALLOY AND MANUFACTURING METHOD THEREOF

(71) Applicants: INSTITUTE OF METAL RESEARCH, CHINESE ACADEMY OF SCIENCES, Shenyang (CN); JIANGSU HAIJIN METALLIC GLASS TECHNOLOGY CO., LTD, Yancheng (CN)

(72) Inventors: Yi Li, Shenyang (CN); Yinxiao Wang, Shenyang (CN); Hongchuan Cai, Jiangsu (CN); Jinjiu Qiu, Jiangsu (CN)

( * ) Notice: Subject to any disclaimer, the term of this patent is extended or adjusted under 35 U.S.C. 154(b) by 189 days.

(21) Appl. No.: 16/500,083

(22) PCT Filed: Apr. 20, 2018

(86) PCT No.: PCT/CN2018/000148

§ 371 (c)(1),
(2) Date: Oct. 1, 2019

(87) PCT Pub. No.: WO2018/209970

PCT Pub. Date: Nov. 22, 2018

(65) Prior Publication Data

US 2021/0102280 A1 Apr. 8, 2021

(30) Foreign Application Priority Data

May 18, 2017 (CN) ..... 201710351253.7

(51) Int. Cl.
*C22C 45/10* (2006.01)
*C22C 1/11* (2023.01)

(52) U.S. Cl.
CPC ..... *C22C 45/10* (2013.01); *C22C 1/11* (2023.01)

(58) Field of Classification Search
None
See application file for complete search history.

(56) References Cited

U.S. PATENT DOCUMENTS

2014/0352907 A1* 12/2014 Zhang ..... B22D 17/12 164/61

FOREIGN PATENT DOCUMENTS

CN 101906598 A * 12/2010

OTHER PUBLICATIONS

Espacenet machine translation of CN 101906598 (Year: 2021).*
Dumbaugh et al., "Laser Fusion Project: Second Annual Report" (1978) (Year: 1978).*

* cited by examiner

*Primary Examiner* — Anthony J Zimmer
*Assistant Examiner* — Nazmun Nahar Shams
(74) *Attorney, Agent, or Firm* — Tsz Lung Yeung

(57) ABSTRACT

A Zr-based amorphous alloy and a manufacturing method thereof, wherein the Zr-based amorphous alloy includes a composition of $(Zr_aHf_bCu_cNi_dAl_e)_{100-x}O_x$, wherein a, b, c, d, e, x are atomic percentages, and $49 \le a \le 55$, $0.05 \le b \le 1$, $31 \le c \le 38$, $3 \le d \le 5$, $7 \le e \le 10.5$, and $0.05 \le x \le 0.5$, wherein based on the volume of the alloy, the Zr-based amorphous alloy is cast into a rod-shaped sample having a diameter of 12-16 mm and a length of 60 mm, an amorphous content of 40%-95%, a strength of above 1800 MPa, and a fracture toughness of higher than 90 $KPam^{1/2}$.

8 Claims, 2 Drawing Sheets

ZR-BASED AMORPHOUS ALLOY AND MANUFACTURING METHOD THEREOF

BACKGROUND OF THE PRESENT INVENTION

Field of Invention

The present invention relates to a Zr-based amorphous alloy having high glass forming ability and excellent mechanical properties and a manufacturing method thereof.

Description of Related Arts

Since the discovery of amorphous alloys, after several decades of research and exploration, many amorphous alloy systems, such as Zr-based, Cu-based, Fe-based, Ti-based, and rare-earth based, have been developed. Among them, Zr-based amorphous alloys have high strength, high elasticity, excellent corrosion resistance and good forming ability, and it is believed that Zr-based amorphous alloys should have great application prospects due to the existence of these excellent properties.

Zr-based bulk amorphous alloys are considered to be a new material in the 21st century. it can be applied for complex parts made of traditional metal materials, such as steel, titanium and aluminum, having a weight below 100 g. Traditional complex parts made of metal materials such as steel, aluminum alloy, and magnesium alloy often require many processing steps. Although the raw material cost is low, the processing cost is very high. However, in addition to a series of excellent mechanical properties such as high strength and high elasticity, Zr-based amorphous alloys also have the characteristics of small shrinkage during solidification, high surface smoothness, and good mold filling ability. These characteristics enable Zr-based amorphous alloys to be formed in a single step by die-casting process, directly obtaining components with complicated shapes and precise dimensions, which greatly reduces processing steps and costs and is also the advantage of Zr-based amorphous alloys in industrial applications. However, the above advantage is offset by the shortcomings that Zr-based bulk amorphous alloys have a significant decrease in glass forming ability, a large reduction in mechanical properties and a lower product yield rate, when they are placed in the industrial high-oxygen and high-impurity environment, such that the Zr-based bulk amorphous alloys cannot meet market requirements and have an extremely limited industrialization speed. Therefore, the solution to the problems encountered in the industrialization process of Zr-based bulk amorphous alloys has become a prerequisite of the wide application of Zr-based bulk amorphous alloys in the future.

In the past, the method for solving the excessive oxygen content of Zr-based bulk amorphous alloy under industrial production conditions is usually to add rare earth elements to the alloy, and to use rare earth elements as "oxygen scavengers" to neutralize the oxygen in the alloy, so that the ability to form amorphous is maintained. However, this method causes the oxide to precipitate and be trapped in the alloy, thereby destroying the mechanical properties of the alloy. Therefore, a Zr-based amorphous alloy containing no rare earth elements and having excellent amorphous forming ability and mechanical properties at a high oxygen content is the only way to promote its large-scale application in the future.

SUMMARY OF THE PRESENT INVENTION

The present invention is advantageous in that it provides a Zr-based amorphous alloy adapted for high oxygen content and a manufacturing method thereof to solve the problems that the existing Zr-based amorphous alloy has poor glass forming ability with a high oxygen content.

Another advantage of the invention is to provide a Zr-based amorphous alloy having a composition of $(Zr_aHf_bCu_cNi_dAl_e)_{100-x}O_x$, wherein a, b, c, d, e, x represent atomic unit, and $49 \le a \le 55$, $0.05 \le b \le 1$, $31 \le c \le 38$, $3 \le d \le 5$, $7 \le e \le 10.5$, $0.05 \le x \le 0.5$. so the Zr-based amorphous alloy includes 49 to 55 atomic percent Zr, 0.05 to 1 atomic percent Hf, 31 to 38 atomic percent Cu, 3 to 5 atomic percent Ni, 7 to 10.5 atomic percent Al and 0.05 to 0.5 atomic percent O. Based on a volume of the Zr-based amorphous alloy, when the Zr-based amorphous alloy is cast into a rod-shaped sample having a diameter of 12-16 mm and a length of 60 mm, it should have an amorphous content of 40%-95% and its strength should reach 1800 MPa or more, and the fracture toughness should be higher than 90 $KPam^{1/2}$.

Another advantage of the invention is to provide a Zr-based amorphous alloy having a composition of $(Zr_aHf_bCu_cNi_dAl_e)_{100-x}O_x$, wherein a, b, c, d, e, x represent atomic unit, and preferably, $52.5 \le a \le 54$, $0.3 \le b \le 0.6$, $33 \le c \le 35.5$, $3.2 \le d \le 4$, $8 \le e \le 10$, $0.05 \le x \le 0.2$, so the Zr-based amorphous alloy includes 52.5 to 54 atomic percent Zr, 0.3 to 0.6 atomic percent Hf, 33 to 35.5 atomic percent Cu, 3.2 to 4 atomic percent Ni, 8 to 10 atomic percent Al and 0.05 to 0.2 atomic percent O. Based on a volume of the Zr-based amorphous alloy, when the Zr-based amorphous alloy is cast into a rod-shaped sample having a diameter of 12-16 mm and a length of 60 mm, it should have an amorphous content of more than 80%.

Another advantage of the invention is to provide a Zr-based amorphous alloy having a composition of $(Zr_aHf_bCu_cNi_dAl_e)_{100-x}O_x$, wherein a, b, c, d, e, x represent atomic unit, and preferably, $50.5 \le a \le 52$, $0.4 \le b \le 0.8$, $36 \le c \le 37.5$, $3 \le d \le 4.5$, $8 \le e \le 10$, $0.05 \le x \le 0.3$, so the Zr-based amorphous alloy includes 50.5 to 52 atomic percent Zr, 0.4 to 0.8 atomic percent Hf, 36 to 37.5 atomic percent Cu, 3 to 4.5 atomic percent Ni, 8 to 10 atomic percent Al and 0.05 to 0.3 atomic percent O. Based on a volume of the Zr-based amorphous alloy, when the Zr-based amorphous alloy is cast into a rod-shaped sample having a diameter of 12-16 mm and a length of 60 mm, it should have an amorphous content of more than 80%.

Another advantage of the present invention is to provide a method for manufacturing the above Zr-based amorphous alloy, which comprises the following three steps: smelting, casting and cooling forming under vacuum or inert gas atmosphere, wherein the raw materials are prepared in accordance with the above atomic percentage, after the weighing, and then smelting the raw materials and the smelting process is carried out under a protective atmosphere of a vacuum or an inert gas, and heating the raw material slowly by induction heating to gradually form a molten pool, and finally, melting all of the raw materials. After heat preservation for a certain time, inverting the melt and casting into a mold and cooling.

The method for manufacturing a Zr-based amorphous alloy according to the present invention is characterized in that it can utilize industrial grade raw materials, and has a low requirement for the purity of the raw materials, so that the cost of the raw material is greatly reduced: the purity of the raw material is >97%, and the requirement of the oxygen content is not higher than 2 at. %. In addition, the invention does not require a high quality of smelting atmosphere, and may select a vacuum environment or an inert gas protective atmosphere. If selecting a vacuum environment, the smelting vacuum should be maintained at 0.5-500 Pa. If using an inert gas for protection, argon gas should be selected. The present invention utilizes the induction melting process to heat and smelt the raw materials, and the crucible may be selected from one of quartz crucible, graphite crucible, calcium oxide crucible and mullite, and during the melting, the power should be slowly increased and the melting temperature is controlled, and the maximum temperature should be 1400° C.~1600° C., and then keeping warm for no less than 180 seconds (the holding time is no less than 180 seconds) at the highest temperature. Finally, pouring the melt into the mold by flip casting, and the casting temperature should be greater than 1100° C. The mold can be made of steel mold, copper mold and the like, and the mold can be cooled by water cooling.

The Zr-based amorphous alloy provided by the invention contains Hf element, and compared with the addition of the rare earth element, the micro-addition of the Hf element improves the glass forming ability thereof, such that the amorphous alloy having a larger critical dimension is more easily prepared. At the same time, the addition of Hf maintains the mechanical properties of the alloy of the invention and avoids increasing the brittleness of the alloy due to the addition of rare earth elements. Meanwhile, the Zr-based amorphous alloy provided by the present invention adds oxygen as an element to the alloy system, and it is actually proved that an excessive low content of the oxygen is not entirely advantageous for the improvement of the mechanical properties of the amorphous alloy, and by increasing appropriately the oxygen content, the invention obtains a most preferable range of the oxygen content, and improves the mechanical properties of the amorphous alloy.

DETAILED DESCRIPTION OF THE PREFERRED EMBODIMENT

The invention is described in detail below with reference to the preferred embodiments of the invention.

The raw materials used in the following examples have a purity of more than 97%, a oxygen content of less than 2 at. %, and the argon has a purity of more than 97%.

Example 1

Composition: $(Zr_{54}Hf_{0.5}Cu_{32.9}Ni_{3.6}Al_9)_{99.95}O_{0.05}$

Figure 1:
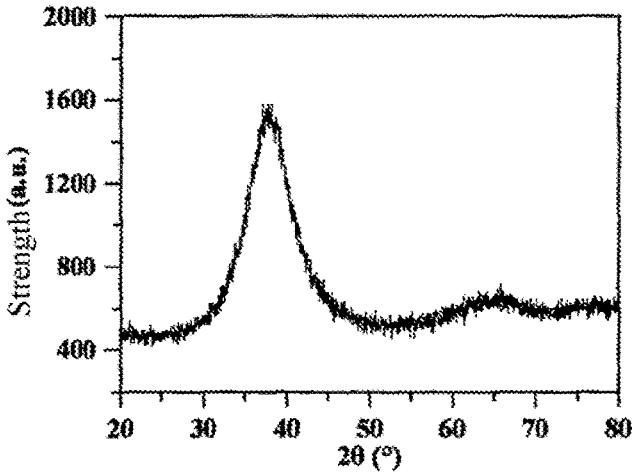
FIG. 1 is a XRD diffraction pattern of the amorphous alloy described in Example 1.
Figure 2:
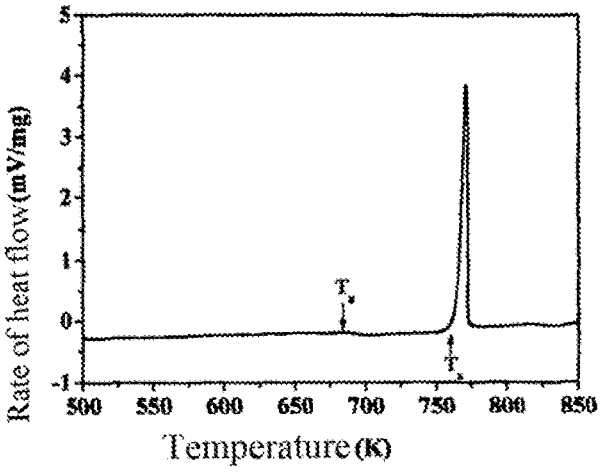
FIG. 2 shows the thermodynamic parameter of the amorphous alloy described in Example 1.
Figure 3:
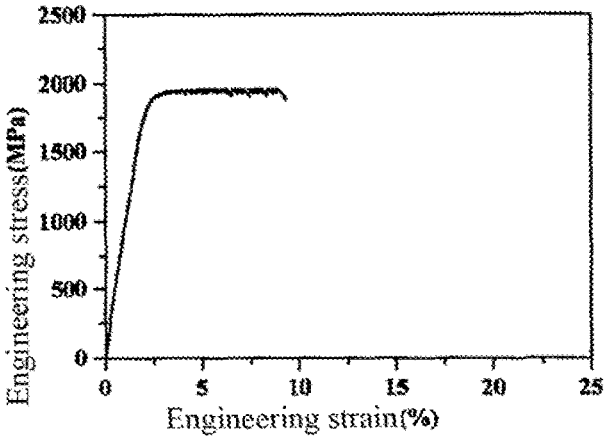
FIG. 3 is a graph showing the mechanical properties of the amorphous alloy described in Example 1.
Figure 6:
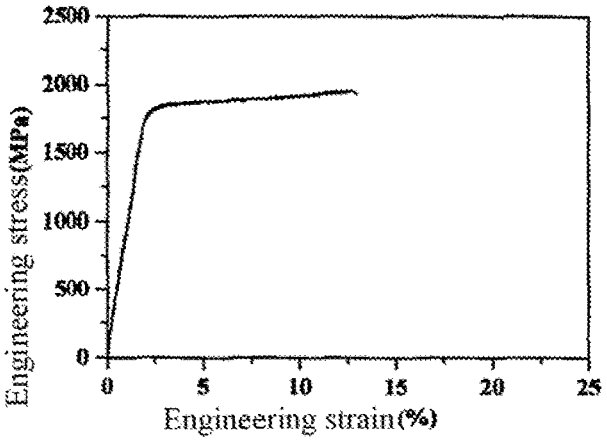
FIG. 6 is a graph showing the mechanical properties of the amorphous alloy described in Example 2.

Placing the raw material in a graphite crucible, vacuuming to 5 Pa, and then smelting the raw material under an argon atmosphere, increasing slowly the power to rise the melting temperature to 1400° C., and then keeping warm for 300 s (the holding time is 300 seconds), and then reducing slowly the power and lowering the temperature to 1200° C. After the temperature is lowered to 1200° C., casting the melt raw material into a copper mold, so as to obtain a rod-shaped sample having a size of Φ12×60 mm, and its amorphous content is 95% by volume. It is analyzed by an XRD diffractometer to determine whether it is amorphous, and its structure is confirmed to be an amorphous structure as shown in FIG. 1. The thermodynamic parameters are measured by DSC, as shown in FIG. 2, the rod-shaped sample has a $T_g$ of 687K and a $T_x$ of 763K. The mechanical properties are tested by a mechanical property testing machine, as shown in FIG. 6, the 2 mm bar compressive has a strength reaching 1941 MPa, a Vickers hardness reaching 544, and a fracture toughness reaching 90 $KPam^{1/2}$.

Example 2

Composition: $(Zr_{50.5}Hf_{0.5}Cu_{36.45}Ni_{4.05}Al_{8.5})_{99.9}O_{0.1}$

Figure 4:
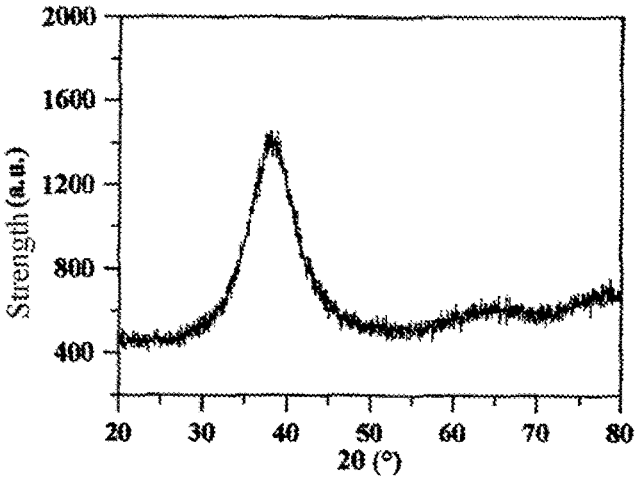
FIG. 4 is a XRD diffraction pattern of the amorphous alloy described in Example 2.
Figure 5:
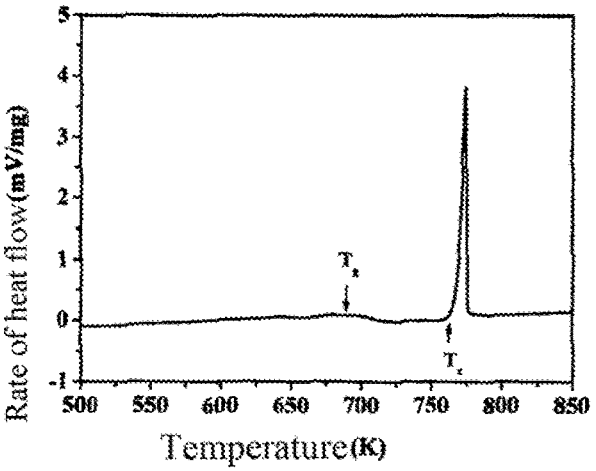
FIG. 5 shows the thermodynamic parameter of the amorphous alloy described in Example 2.

Placing the raw material in a quartz crucible, vacuuming to 5 Pa, and then smelting the raw material under an argon atmosphere. Increasing slowly the power to rise the melting temperature to 1500° C., and then keeping warm for 240 s (the holding time is 240 seconds), and then reducing slowly the power and lowering the temperature to 1150° C. After the temperature is lowered to 1150° C., casting the melt raw material into a copper mold, so as to obtain a rod-shaped sample having a size of Φ16×60 mm, and its amorphous content is 99% by volume. It is analyzed by an XRD diffractometer to determine whether it is amorphous, and its structure is confirmed to be an amorphous structure as shown in FIG. 4. The thermodynamic parameters are measured by DSC, as shown in FIG. 5, which has a $T_g$ of 690K and a $T_x$ of 767K. The mechanical properties are tested by a mechanical property testing machine. As shown in FIG. 6, the 2 mm bar compressive has a strength reaching 1890 MPa, a Vickers hardness reaching 550, and a fracture toughness reaching 93 $KPam^{1/2}$.

Example 3

Composition: $(Zr_{52.7}Hf_{0.3}Cu_{34.2}Ni_{3.8}Al_9)_{99.7}O_{0.3}$

Placing the raw material in a graphite crucible, vacuuming to 15 Pa, and then smelting the raw material under a vacuum atmosphere. Increasing slowly the power to rise the melting temperature to 1600° C., and then keeping warm for 240 s (the holding time is 240 seconds), and then reducing slowly the power and lowering the temperature to 1100° C. After the temperature is lowered to 1100° C., casting the melt raw material into a copper mold, so as to obtain a rod-shaped sample having a size of Φ12×60 mm, and its amorphous content is 90% by volume.

Example 4

Composition: $(Zr_{50.6}Hf_{0.4}Cu_{35.1}Ni_{3.9}Al_{10})_{99.8}O_{0.2}$

Placing the raw material in a graphite crucible, vacuuming to 0.5 Pa, and then smelting the raw material under an argon atmosphere. Increasing slowly the power to rise the melting temperature to 1400° C., and then keeping warm for 180 s (the holding time is 180 seconds), and then reducing slowly the power and lowering the temperature to 1200° C. After the temperature is lowered to 1200° C., casting the melt raw material into a copper mold, so as to obtain a rod-shaped sample having a size of Φ16×60 mm, and its amorphous content is 90% by volume.

Example 5

Composition: $(Zr_{53.7}Hf_{0.3}Cu_{34.2}Ni_{3.8}Al_8)_{99.9}O_{0.1}$

Placing the raw material in a calcium oxide crucible, vacuuming to 10 Pa, and then smelting the raw material under an argon atmosphere. Increasing slowly the power to rise the melting temperature to 1500° C., and then keeping warm for 240 s (the holding time is 240 seconds), and then reducing slowly the power and lowering the temperature to 1150° C. After the temperature is lowered to 1150° C., casting the melt raw material into a copper mold, so as to obtain a rod-shaped sample having a size of Φ12×60 mm, and its amorphous content is 80% by volume.

Example 6

Composition: $(Zr_{54.1}Hf_{0.9}Cu_{31.5}Ni_{3.5}Al_{10})_{99.85}O_{0.15}$

Placing the raw material in a calcium oxide crucible, vacuuming to 10 Pa, and then smelting the raw material under an argon atmosphere. Increasing slowly the power to rise the melting temperature to 1500° C., and then keeping warm for 240 s (the holding time is 240 seconds), and then reducing slowly the power and lowering the temperature to 1150° C. After the temperature is lowered to 1150° C., casting the melt raw material into a copper mold, so as to obtain a rod-shaped sample having a size of Φ12×60 mm, and its amorphous content is 70% by volume.

Example 7

Composition: $(Zr_{54.9}Hf_{0.1}Cu_{34.2}Ni_{3.8}Al_7)_{99.7}O_{0.3}$

Placing the raw material in a calcium oxide crucible, vacuuming to 50 Pa, and then smelting the raw material under an argon atmosphere. Increasing slowly the power to rise the melting temperature to 1600° C., and then keeping warm for 240 s (the holding time is 240 seconds), and then reducing slowly the power and lowering the temperature to 1200° C. After the temperature is lowered to 1200° C., casting the melt raw material into a copper mold, so as to obtain a rod-shaped sample having a size of Φ12×60 mm, and its amorphous content is 70% by volume.

Example 8

Composition: $(Zr_{50.2}Hf_{0.8}Cu_{37.8}Ni_{4.2}Al_7)_{99.9}O_{0.1}$

Placing the raw material in a calcium oxide crucible, vacuuming to 5 Pa, and then smelting the raw material under an argon atmosphere. Increasing slowly the power to rise the melting temperature to 1400° C., and then keeping warm for 300 s (the holding time is 300 seconds), and then reducing slowly the power and lowering the temperature to 1200° C. After the temperature is lowered to 1200° C., casting the melt raw material into a copper mold, so as to obtain a rod-shaped sample having a size of Φ16×60 mm, and its amorphous content is 50% by volume.

Example 9

Composition: $(Zr_{49.3}Hf_{0.7}Cu_{37.8}Ni_{4.2}Al_8)_{99.5}O_{0.5}$

Placing the raw material in a calcium oxide crucible, vacuuming to 10 Pa, and then smelting the raw material under an argon atmosphere. Increasing slowly the power to rise the melting temperature to 1600° C., and then keeping warm for 180 s (the holding time is 180 seconds), and then reducing slowly the power and lowering the temperature to 1150° C. After the temperature is lowered to 1150° C., casting the melt raw material into a copper mold, so as to obtain a rod-shaped sample having a size of Φ 16×60 mm, and its amorphous content is 40% by volume.

Example 10

Composition: $(Zr_{49.4}Hf_{0.6}Cu_{35.55}Ni_{3.95}Al_{10.5})_{99.6}O_{0.4}$

Placing the raw material in a calcium oxide crucible, vacuuming to 1 Pa, and then smelting the raw material under an argon atmosphere. Increasing slowly the power to rise the melting temperature to 1500° C., and then keeping warm for 180 s (the holding time is 180 seconds), and then reducing slowly the power and lowering the temperature to 1100° C. After the temperature is lowered to 1100° C., casting the melt raw material into a copper mold, so as to obtain a rod-shaped sample having a size of Φ16×60 mm, and its amorphous content is 50% by volume.

The above embodiments are merely illustrative of the technical concept and the features of the invention and the purpose of the invention is to enable those skilled in the art to understand the invention and to implement the invention, and the scope of the invention is not limited thereto. Equivalent variations or modifications made in accordance with the spirit of the invention are intended to be included within the scope of the invention.

What is claimed is:

1. A Zr-based amorphous alloy, wherein the Zr-based amorphous alloy composition is $(Zr_{49.3}Hf_{0.7}Cu_{37.8}Ni_{4.2}Al_8)_{99.5}O_{0.5}$, wherein the Zr-based amorphous alloy has a seize reaching diameter of Φ16 mm with a length of 60 mm, a strength above 1800 MPa, and a fracture toughness higher than 90 $KPam^{1/2}$.

2. A method for manufacturing a Zr-based amorphous alloy characterized in that, a raw material is heated and smelted by induction melting, a power is increased during smelting and the melting temperature is controlled, and the melting temperature is 1400-1600° C., and a holding time is not less than 180 seconds at a highest temperature, and the melt is poured into a mold by flip casting, and a casting temperature is higher than 1100° C., wherein the Zr-based amorphous alloy composition is $(Zr_aHf_bCu_cNi_dAl_e)_{100-x}O_x$ wherein a, b, c, d, e, x represent atomic unit and $49 \le a \le 55$, $0.05 \le b \le 1$, $31 \le c \le 38$, $3 \le d \le 5$, $7 \le e \le 10.5$, $0.05 \le x \le 0.5$.

3. The method for manufacturing a Zr-based amorphous alloy according to claim 2, wherein the raw material has a purity of no less than 97% and an oxygen content of not higher than 2 at %.

4. The method for manufacturing a Zr-based amorphous ally according to claim 2, wherein a crucible used in the smelting process is one of a quartz crucible, a graphite crucible, a calcium oxide crucible and a multiple crucible.

5. The method for manufacturing a Zr-based amorphous alloy according to claim 2, characterized in that, the Zr-based amorphous alloy is smelted under vacuum, and the degree of vacuum required is from 0.5 to 500 Pa.

6. The method for manufacturing a Zr-based amorphous alloy according to claim 2, wherein a smelting protective gas is argon.

7. The method for manufacturing a Zr-based amorphous alloy according to claim 2, wherein the Zr-based amorphous alloy composition is $(Zr_aHf_bCu_cNi_dAl_e)_{100-x}O_x$ wherein a, b, c, d, e, x represent atomic unit, and $52.5 \le a \le 54$, $0.3 \le b \le 0.6$, $33 \le c \le 35.5$, $3.2 \le d \le 4$, $8 \le e \le 10$, $0.05 \le x \le 0.2$.

8. The method for manufacturing a Zr-based amorphous alloy according to claim 2, wherein the Zr-based amorphous alloy composition is $(Zr_aHf_bCu_cNi_dAl_e)_{100-x}O_x$ wherein a, b, c, d, e, x represent atomic unit and $50.5 \leq a \leq 52$, $0.4 \leq b \leq 0.8$, $36 \leq c \leq 37.5$, $3 \leq d \leq 4.5$, $8 \leq e \leq 10$, $0.05 \leq x \leq 0.3$.

* * * * *